US006425141B1

(12) United States Patent
Ewing et al.

(10) Patent No.: US 6,425,141 B1
(45) Date of Patent: Jul. 30, 2002

(54) PROTECTIVE HELMET

(75) Inventors: James Scott Ewing, Chevy Chase; Maria Maroulis, Bowie; Andrew F. Conn, Baltimore, all of MD (US)

(73) Assignee: Cerebrix, Chevy Chase, MD (US)

( * ) Notice: Subject to any disclaimer, the term of this patent is extended or adjusted under 35 U.S.C. 154(b) by 0 days.

(21) Appl. No.: 09/127,125

(22) Filed: Jul. 30, 1998

(51) Int. Cl.[7] ..... A42B 3/12
(52) U.S. Cl. ..... 2/412
(58) Field of Search ..... 2/410, 411, 412, 2/414; 293/120

(56) References Cited

U.S. PATENT DOCUMENTS

| | | | | | |
|---|---|---|---|---|---|
| 3,047,888 | A | | 8/1962 | Shecter et al. | |
| 3,118,153 | A | | 1/1964 | Hood | |
| 3,350,718 | A | | 11/1967 | Webb | |
| 3,447,163 | A | * | 6/1969 | Bothwell et al. | 2/412 |
| 3,790,436 | A | | 2/1974 | Graham, Jr. et al. | |
| 3,818,508 | A | * | 6/1974 | Lammers et al. | 2/412 |
| 3,885,258 | A | | 5/1975 | Regan | |
| 3,939,508 | A | | 2/1976 | Hall et al. | |
| 3,946,441 | A | * | 3/1976 | Johnson | 2/412 |
| 4,006,496 | A | | 2/1977 | Marker | |
| 4,020,507 | A | * | 5/1977 | Morton | 2/411 |
| 4,042,746 | A | | 8/1977 | Hofer | |
| 4,484,361 | A | | 11/1984 | Leighton et al. | |
| 4,627,114 | A | | 12/1986 | Mitchell | |
| 4,710,984 | A | | 12/1987 | Asper et al. | |
| 4,722,563 | A | * | 2/1988 | Loren et al. | 293/120 |
| 5,056,162 | A | * | 10/1991 | Tirums | 2/412 |
| 5,309,576 | A | | 5/1994 | Broersma | |
| 5,343,569 | A | * | 9/1994 | Asare et al. | 2/412 |
| 5,351,341 | A | | 10/1994 | Broersma | |
| 5,518,806 | A | | 5/1996 | Eder et al. | |
| 5,604,021 | A | | 2/1997 | Wagner | |
| 5,754,491 | A | | 5/1998 | Cushman | |
| 5,937,446 | A | * | 8/1999 | Fallert | 2/412 |
| 6,065,158 | A | * | 5/2000 | Rush, III | 2/412 |
| 6,070,271 | A | * | 6/2000 | Williams | 2/412 |
| 6,108,825 | A | * | 8/2000 | Bell et al. | 2/455 |

FOREIGN PATENT DOCUMENTS

| | | | | |
|---|---|---|---|---|
| DE | 3607583 | * | 9/1987 | 2/411 |
| EP | 571065 | * | 11/1993 | 2/411 |
| WO | 8401697 | * | 5/1984 | 2/411 |
| WO | 90/14025 | * | 11/1990 | 2/410 |

* cited by examiner

*Primary Examiner*—Peter Nerbun
(74) *Attorney, Agent, or Firm*—Michael Best & Friedrich LLP; Teresa J. Welch; Jeffrey D. Peterson

(57) ABSTRACT

A helmet is formed with a rigid outer shell and three energy-absorbing layers made of two types of CONFOR™ ergonomic, open-celled polyurethane foams. The first layer adjacent the rigid outer shell is a CONFOR™ CF-40 yellow foam and the middle layer is a CF-47 green foam, which is of greater stiffness than the outer layer. The inner-most layer is also a CF-40 yellow foam and, therefore, identical to the outer energy-absorbing layer. The three layers are 0.5" thick. The helmet body is secured to a user's head with straps, affording a helmet design capable of continuously absorbing energy from multiple impacts while retaining the property of returning completely to its original shape. The multiple layering of materials having different stiffnesses results in the reflection of propagating stress waves through the materials, ultimately absorbing larger amounts of energy than the same materials not layered with alternating stiffnesses could absorb.

26 Claims, 2 Drawing Sheets

PROTECTIVE HELMET

FIELD OF THE INVENTION

The present invention relates generally to helmet construction and, more particularly, to a new and improved protective helmet for use primarily by persons engaged in sporting or other activities exposed to the risk of head injury.

BACKGROUND OF THE INVENTION

Helmets. Helmets used by bicyclists and others engaged in sports typically have a hard outer shell that covers energy-absorbing material. Bicycle helmets typically have a hard plastic outer shell that covers expanded polystyrene. Polystyrene absorbs energy by developing multiple micro-fractures throughout its structure. Once a polystyrene helmet develops micro-fractures it ceases to provide impact protection (i.e., such helmets are unusable after a single impact). Football helmets typically have a dense polyethylene outer shell that covers polypropylene pads capable of absorbing multiple impacts. Other helmets, such as those used by soldiers, typically have a metal or composite shell; that is able to protect a soldier's head from certain types of high-energy impacts.

Helmets typically have a retention system to secure the helmet in proper position on the user's head. The straps commonly used for bicycle helmets are difficult to adjust, resulting in many bicyclists wearing helmets improperly positioned and providing limited protection.

The helmet shape and the extent to which it covers the head are important design considerations. Helmets are shaped differently depending on the use to which the helmet is to be put and the energy level of the impacts the user might experience. Bicycle helmets are typically designed to protect the top, sides and front of the user's head.

Performance standards have been developed for certain types of helmets. For bicycle helmets, for example, the Snell B-95 Bicycle Helmet Standard involves a series of performance tests. A helmet passes the impact portion of the Snell test if it prevents a head from decelerating at a rate in excess of 300 G's when subjected to a specific test impact. The Snell 300 G's standard does not assure that a rider wearing a helmet meeting that standard will not suffer serious head injury. Head and brain injuries occur at deceleration levels well below 300 G's; also, riders can experience impacts that result in head deceleration levels above 300 G's.

Head Injury. The head can be thought of as having three components: the skull; the brain, which consists of compressible matter; and the fluid filling the skull and in which the brain floats. Neither the skull nor the fluid is compressible; the brain, however, is compressible and, when forced against the skull, does compress, bruising brain tissue and perhaps causing hemorrhaging. When the skull experiences an impact, the force is transmitted through the skull and fluid; the inertia of the fluid results in the brain moving in a direction opposite from that of the force applied to the skull. If that force is applied suddenly (i.e., there is an impact) and is substantial enough, the brain moves through the fluid and strikes the inside of the skull at a point roughly opposite to the area of the skull that sustains the impact.

When the brain strikes the skull with moderate force, the brain tissue in the area of the brain that hits the skull is compressed and bruised. That typically results in a temporary cessation of nervous function (i.e., a concussion).

When the skull is subjected to a more substantial impact, the brain typically hits the inside of the skull at a higher speed; a larger area of brain tissue is compressed and damaged and brain hemorrhaging is common (i.e., contusion results). If minimal hemorrhaging occurs, the individual may experience symptoms similar to those of a concussion. More substantial hemorrhaging may result in a loss of blood supply to the brain and even death.

When the energy level of the impact to the skull is substantial enough, the skull fractures. When it does, some of the impact energy is dissipated. A fracture may be either linear or localized. A linear fracture, the simpler of the two, is essentially a straight line crack. A localized fracture is one in which multiple fractures occur in a single area. In such a fracture, it is common for skull bone material to be displaced; the displacement can result in bone material penetrating brain tissue, causing hemorrhaging and swelling.

Research Considerations. We concluded it would be desirable to design a helmet that achieved the lowest possible rate of deceleration and thus maximum protection for the head. Published research suggests that the human skull can fracture at decelerations as low as 225 G's and that concussions can occur at substantially lower decelerations.

Published research showing that most helmet impacts experienced by bicyclists occurred at the right and left temporal areas of the head aided us in product design. Other research aided us in designing our tests and in identifying materials worthy of consideration.

SUMMARY OF THE INVENTION

One object of the present invention is to provide a helmet having multiple foam layers for reducing the deceleration experienced by the head.

Another object of the present invention is to provide a new, improved protective helmet that will, under the testing criteria employed, prevent a head from decelerating at a rate in excess of 100 G's.

Yet another object is to provide a helmet arrangement that can withstand multiple impacts and still be reusable.

Still a further object is to provide a new, improved protective helmet that can be easily and efficiently manufactured and marketed.

Another object is to provide a new, improved protective helmet of a durable and reliable construction.

Yet another object is to provide a protective helmet that can be manufactured at an economically acceptable cost to the buying public.

The present invention can be characterized in a variety of ways. In one characterization, the helmet is comprised of a relatively stiff outer shell and a plurality of impact-energy-absorbing material layers disposed within the outer shell in juxtaposition to each other. At least one of these impact-energy-absorbing material layers is made of an open-celled polyurethane foam.

The invention may also be characterized as a helmet comprising a relatively stiff outer shell and a plurality of impact-energy-absorbing material layers disposed within the outer shell in juxtaposed position to each other. The impact-energy-absorbing material layers, in combination with the relatively stiff outer shell, are selected so that the helmet will prevent a head from decelerating at a rate in excess of 100 G's under the testing criteria employed.

It is further theorized that the invention can be characterized as a helmet comprising a relatively stiff outer shell and a plurality of impact-energy-absorbing material layers disposed within the outer shell in juxtaposed position to each other. In accordance with this characterization of the invention, the material layers are selected such that they are capable of restoring to their original shape following impact and/or repeated impacts.

In a preferred embodiment, the present invention is directed to a helmet comprised of an outer shell, energy-absorbing layers, and a retention system for securing the helmet to the user's head. Importantly, the energy-absorbing layers comprise at least a first layer of impact-energy-absorbing material adjacent to the outer shell, a second layer of impact-energy-absorbing material adjacent to the first layer, and a third layer of impact-energy-absorbing material adjacent to the second layer and to the wearer's head.

Although the preferred embodiment is comprised of three layers of open-celled foam, it is theorized that the three layers may be replaced with four, five or more layers preferably each having lesser thickness than each layer in the three-layer embodiment to avoid construction of an unnecessarily large helmet. If four or more layers are utilized, the composite thickness preferably is the same as the thickness achieved in the three-layer design.

In the preferred embodiment, the outer shell is preferably made of PETG (glycol-modified polyethylene terephthalate), which is a copolyester plastic having excellent impact strength, durability and the ability to be thermoformed. Preferably, but not necessarily, the outer shell has an optimal thickness of 0.02 inch.

Also in the preferred embodiment, the first of the energy-absorbing layers (i.e., the layer adjacent to the outer shell) is made of ergonomic, open-celled polyurethane foam, such as CONFOR™ foam manufactured by E-A-R Specialty Composites Corporation.

In the preferred embodiment, the first layer is made of CF-40 yellow foam. The second layer is preferably made of ergonomic, open-celled polyurethane foam having a higher stiffness than the first layer. The second layer, in the preferred embodiment, is made of CF-47 green foam.

The third of the energy absorbing layers, the layer closest to the head, is preferably made of the same material as the first layer. In the preferred embodiment, therefore, the third layer preferably is also made of CF-40 yellow foam.

Each of the three energy absorbing layers is preferably about 0.5 inch thick.

The foregoing materials were selected as a result of extensive testing of and experimentation on these and other foams.

The foregoing materials were also selected because of other important characteristics they possess, such as having low-impact, high-rebound properties. These materials conform easily to different shapes, such as the shape of a wearer's head, and are non-irritating in dermal contact.

An important feature of the invention is the multiple layering of energy-absorbing foams of different stiffnesses (some or all of the layers may or may not have the same density). The layering pattern of such foams results in a structure that reflects propagating stress waves upon impact through the materials and that ultimately enables the structure to absorb larger amounts of energy than the same individual material not layered with alternating stiffnesses. The foregoing layering pattern of the invention was selected following extensive experimentation and calculation.

The retention system preferably comprises three separate straps. The first strap is wrapped around the front of the head and attached to an occipital support. This first strap is elastic and is independent of the rest of the strapping.

The second strap is preferably looped through two holes formed in the shell and the foam layers and is pulled down over the ear in a V-shaped form. The third strap is symmetric to this strap on the other side of the helmet. Preferably, two individual straps are used, rather than a single strap. (A single strap is used in many helmets today.) Other retention systems can also be used.

An advantage of using open-celled polyurethane foam, such as the CONFOR™ foam, is that it can withstand multiple impacts. The helmet of the present invention absorbs energy notwithstanding multiple impacts; it also rebounds, beneficially returning to its original shape over time. Therefore, the helmet of the present invention can be used over and over again; it does not have to be replaced after a single impact. Indeed, if in a single accident the helmet receives more than one impact, the foam's properties, including its ability to retain shape, advantageously insure that the helmet maintains its integrity and purpose. In contrast, most helmets currently in use dissipate energy by cracking. Once such a helmet has dissipated energy it will not protect against injury and must be discarded.

The aforementioned novel use of the CONFOR™ material is complimented by the further advantage that the material is soft and extremely comfortable, in contrast to the rigid expanded polystyrene commonly used today.

Although the preferred embodiment features three layers of impact-energy absorbing, open-celled polyurethane foam, the scope of the invention contemplates additional energy-impact absorbing layers as may occur to persons skilled in this art following review of the novel disclosure herein. In some circumstances, it is theorized that the objects of the invention may be achieved with two layers of open-celled polyurethane foam (e.g., CONFOR™ materials), appropriately sized and dimensioned in thickness.

It is within the scope of this invention to utilize energy-absorbing layers of varying thickness and not necessarily the same thickness as in the preferred embodiment.

One or more comfort pad strips may be attached to this exposed inner surface to allow air to circulate between the helmet and head without denigrating the performance characteristics of the helmet.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modification in various obvious respects, all without departing from the invention. Accordingly, the drawings and description thereof are to be regarded as illustrative in nature, not as restrictive.

BRIEF DESCRIPTION OF DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
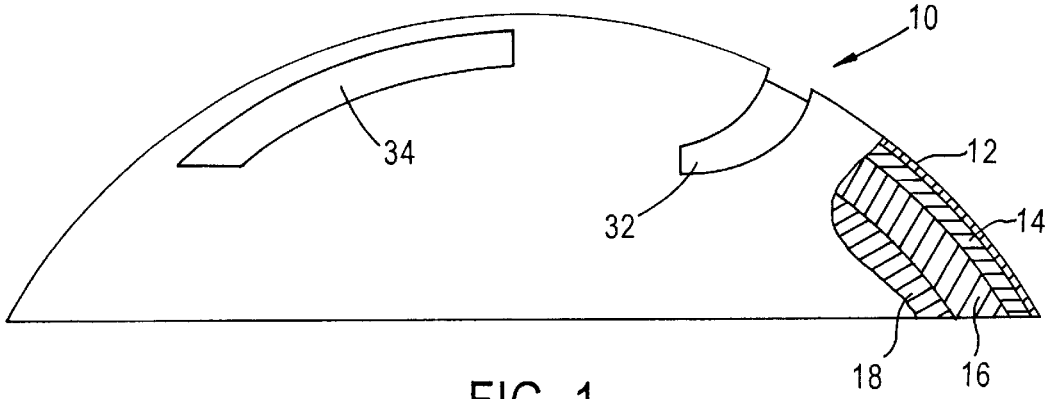
FIG. 1 is a side elevational view, having a partial cross section, of the helmet structure of the present invention with retention straps omitted for clarity.

Refer now to FIG. 1 where a helmet, generally indicated by reference numeral 10, that is constructed in accordance with the principles of the present invention is depicted. For convenience, helmet 10 is depicted in an upright position as helmet 10 would normally be worn by a wearer, although the orientation depicted is for clarity of description only and the helmet is not limited to the orientation depicted.

The present invention is believed to be applicable to a wide range of activities, including but not limited to, bicycling; motorcycling; auto racing; skiing; snow boarding; horseback riding; ice skating; roller skating; inline skating; hang gliding; climbing; spelunking; laying football, hockey and other sports; and working, such as performing construction work. Other applications, besides helmets, may include elbow/knee pads, cushions (car or seat), and bumpers.

Helmet 10 has a dome shape and is approximately 4½" high by 8½" long. Helmet 10 includes an outer shell made of copolyester plastic (e.g., PETG) having a thickness of between 0.02"–0.125" with 0.02"–0.03" being a preferred thickness range. PETG film is available from Eastman Kodak and is called Kodar PETG copolyester 6763.

Adjacent to the inner surface of outer shell 12 is a first layer of CONFOR™ CF-40 yellow foam (layer 14). Adjacent to the inner surface of layer 14 is a second layer of CONFOR™ CF-47 green foam (layer 16). CONFOR™ CF-47 green foam has a higher stiffness than CF-40 yellow foam. Adjacent to the inner surface of layer 16 is a third layer of CONFOR™ CF-40 yellow foam (layer 18). Layers 14, 16 and 18 are each approximately ½" thick. Layers 14, 16, 18 are placed one upon another and layers 14, 16, and 18 conform their shape to that of the outer shell 12 creating a cavity for receiving a portion of the user's head.

CONFOR™ foams are open-celled polyurethane foams from E-A-R Specialty Composite Corporation. These foams are multiple-impact foams, are excellent for energy absorption, are effective under compression, and are soft and flexible. They are also breathable and non-irritating in dermal contact. They conform to any shape, come in varying stiffnesses, cushion well against shock and vibration, and have a slow rate of recovery after deflection, thus eliminating the secondary impact effects that would occur if the rate at which the material recovered its pre-impact shape were too rapid.

Several comfort pad strips can be positioned on the surface of layer 18 adjacent to the wearer's head to provide a gap between layer 18 and a wearer's head to allow air to flow therebetween. Each of the layers of foam 14, 16 and 18 can be bonded together with an adhesive. Such adhesive has a minimal effect on the ability of the foam to absorb energy.

A plurality of vents, 32, 34, are formed in helmet 10. Layers 14, 16 and 18 are continuous sheets of material except for the vents 32, 34.

Figure 2:
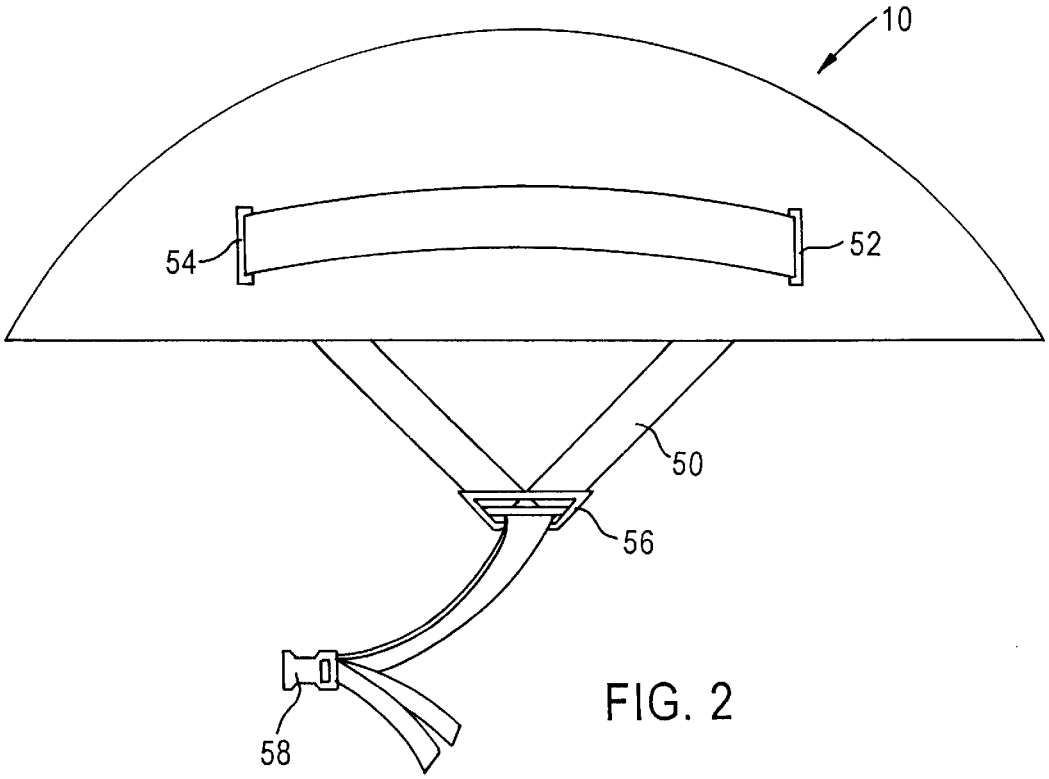
FIG. 2 is a side elevational view of the helmet of FIG. 1 with only one V-shaped side strap shown for clarity.
Figure 3:
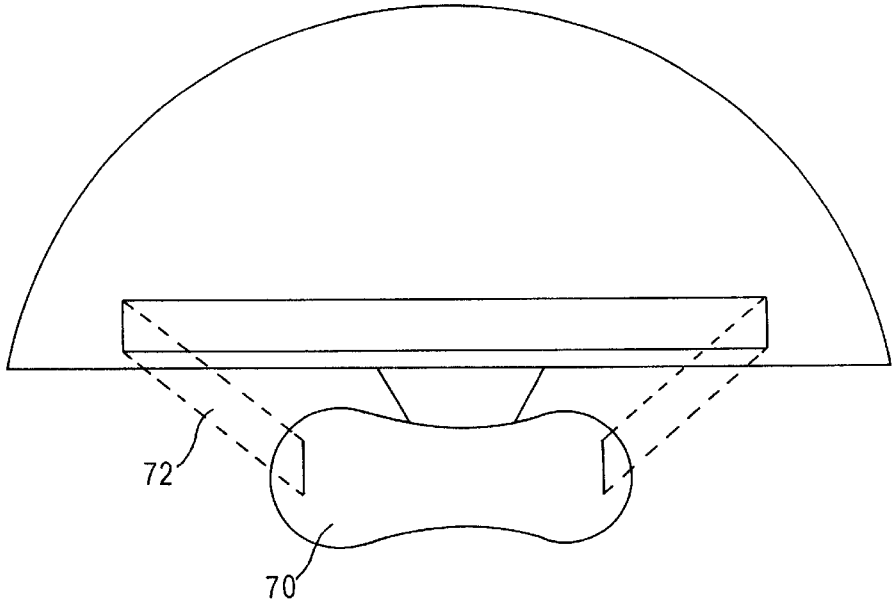
FIG. 3 is a front elevational view depicting an occipital support.
Figure 4A:
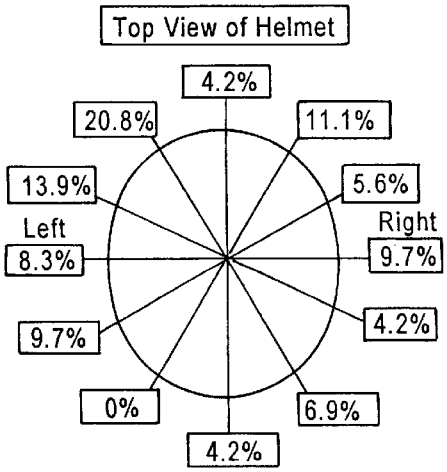
FIGS. 4A and 4B consist of a schematic top view and a left side view of a human head depicting frequency of impact on different regions of a bicyclist's head based on empirical data.
Figure 4B:
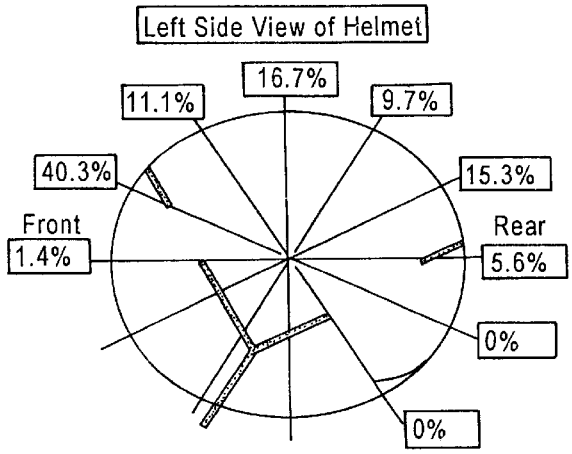

Refer now to FIGS. 2 and 3 where a retention system is depicted. A first strap 50 is looped through a pair of vertical slots 52, 54 and a portion of the strap extends in a longitudinal direction on helmet 10. Vertical slots 52, 54 each extend through helmet 10 from an outer surface of the outer shell 12 through an inner surface of layer 18. The two ends of strap 50 are looped through the vertical slots and are pulled down over the ear in a V-shaped form through a retainer 56 and through a buckle 58. The second strap on the other side of the helmet is symmetric to the first strap; a male fastener (not shown) would be used to mate with fastener 58. In most conventional helmets, a single strap is used to form the V-shape on both sides. The use of two separate straps makes easier adjustment. The retention straps are available from American Cord and Webbing Co., Inc. of Woonsocket, R.I. The length of strap 50 can be adjusted to suit the needs of the wearer. The side straps use nylon webbing that is 1" wide.

In FIG. 3, an occipital support 70 is depicted. Occipital support 70 is secured to helmet 10 by an elastic strap 72 that is independent of the other two straps.

Many potential impact-energy-absorbing materials, both single- and multiple-impact, were tested; various thicknesses of the materials were tested; several possible outer shell covers were also tested. These materials were then layered in a number of different combinations and tested to gain a greater understanding of the propagation and reflection of stress waves in these materials.

Helmets made according to the present invention achieved head deceleration levels of 85.7 G's and 90 G's; in certain tests, helmets constructed according to the present invention achieved decelerations as low as 76 G's. In contrast, a football helmet we tested provided results of approximately 156 G's, and a single-impact bicycle helmet we tested provided results of approximately 285 G's.

It will be readily seen by one of ordinary skill in the art that the present invention fulfills all the objects set forth above. After reading the foregoing specification, one of ordinary skill will be able to effect various changes, substitution of equivalents and various other aspects of the invention as broadly disclosed herein. It is, therefore, intended that the protection granted hereon be limited only by the definition contained in the appended claims and equivalents thereof.

What is claimed is:

1. A helmet, comprising:

a) a stiff shell;

b) a first layer of impact-energy-absorbing material adjacent said shell;

c) a second layer of impact-energy-absorbing material adjacent said first layer; and d) a third layer of impact-energy-absorbing material adjacent said second layer;

said second layer having a dynamic impedance higher than the dynamic impedance of said first and third layers;

said shell having a stiffness greater than said first and third layers.

2. The helmet of claim 1, wherein said first layer and said third layer are the same material.

3. The helmet of claim 2, wherein said first layer and said third layer are a low dynamic impedance foam.

4. The helmet of claim 1, wherein said first layer and said third layer are of a polymeric material.

5. A helmet, comprising:

a) a stiff shell;

b) a first layer of impact-energy-absorbing material adjacent said shell;

c) a second layer of impact-energy-absorbing material adjacent said first layer; and d) a third layer of impact-energy-absorbing material adjacent said second layer;

said second layer having a dynamic impedance higher than the dynamic impedance of said first and third layers;

said shell having a stiffness greater than said first and third layers;

said first layer, said second layer, and said third layer are open-celled polyurethane foams.

6. The helmet of claim 1, wherein said first, second and third layers return to their original shape after receiving an impact.

7. The helmet of claim 1, wherein said first layer, said second layer and said third layer are generally coextensive with each other.

8. The helmet of claim 1, wherein said helmet is usable as one of a bicycle helmet, a motorcycle helmet, auto racing helmet, skiing helmet, snowboarding helmet, horseback riding helmet, ice skating helmet, roller skating helmet, inline skating helmet, hang gliding helmet, climbing helmet, spelunking helmet, football helmet, hockey helmet, and work helmet.

9. The helmet of claim 1, wherein said helmet has a dome shape.

10. The helmet of claim 1, wherein said first and third layers are made of the same type of material.

11. The helmet of claim 10, wherein said first and third layers are made of the same type of material having the same dynamic impedance.

12. The helmet of claim 10, wherein said second layer is made of the same type of material as the first and third layers.

13. A helmet, comprising a) a stiff shell having an inner surface;

b) at least three impact-energy-absorbing material layers disposed within said shell injuxtaposed position to each other;

all of said layers being continuous; and one of said layers being adjacent to and co-extensive with substantially the majority of said inner surface of said shell;

wherein said impact energy absorbing material layers have different dynamic impedances, the layers being arranged so that a layer of low dynamic impedance precedes a layer of high dynamic impedance, which precedes a layer of low dynamic impedance;

said shell having a stiffness greater than said layers.

14. The helmet of claim 13, further comprising straps operatively connected to at least one of the shell and plural layers to secure the helmet to a user's head.

15. The helmet of claim 13, wherein at least one of the impact-energy-absorbing material layers are made of polymeric material.

16. The helmet of claim 13, further comprising vents formed in said helmet.

17. A helmet, comprising:

a) a stiff shell; and b) at least three impact-energy-absorbing material layers disposed within said shell in juxtaposed position to each other, wherein said impact-energy-absorbing material layers and said stiff shell are selected so that the helmet will prevent a head from decelerating at a rate in excess of 125 G's when the helmet, which was affixed to a 20 lb. head form, was dropped onto a concrete platform from a height of 4'2";

said shell having a stiffness greater than said layers.

18. The helmet of claim 17, wherein at least one of the impact-energy-absorbing material layers is made of a polymeric material.

19. A protective device comprising:

a) a stiff shell;

b) a first layer of impact-energy-absorbing material having a first dynamic impedance and located adjacent said shell;

c) a second layer of impact-energy-absorbing material adjacent said first layer and having a second dynamic impedance higher than the first dynamic impedance; and d) a third layer of impact-energy-absorbing material adjacent said second layer and having a third dynamic impedance lower than said second dynamic impedance;

said shell having a stiffness greater than said first and third layers.

20. A helmet, comprising a stiff outer shell having an inner surface, and inner layers of energy-absorbing foamed polymeric material superposed on each other and co-extensive with substantially the majority of the inner surface of the shell;

one of said layers being in direct contact with the shell;

the layers having differing dynamic impedances, a layer in direct contact with said shell having a low dynamic impedance, and subsequent layers being arranged in a pattern of alternating high and low dynamic impedances to each other;

said shell having a stiffness greater than said inner layers.

21. A protective device, comprising a stiff outer shell having an inner surface, and inner layers of energy-absorbing foamed polymeric material, said layers superposed on each other and co-extensive with substantially the majority of the inner surface of the shell;

one of said layers being in direct contact with the shell;

the layers having differing dynamic impedances, a layer in direct contact with said shell having a low dynamic impedance, and subsequent layers being arranged in a pattern of alternating high and low dynamic impedances to each other;

said shell having a stiffness greater than said inner layers.

22. A device for protecting a wearer from impact, comprising a shell, a first layer of energy-absorbing foamed polymeric material superposed on the inside of the shell, a second layer of energy-absorbing foamed polymeric material superposed on the first layer, the second layer in contact with the wearer;

the layers having differing dynamic impedances, the first layer having a lower dynamic impedance than the second layer.

23. A helmet, comprising a shell having an inside surface and layers of energy absorbing foamed polymeric material liners disposed on the inside surface of the shell;

the inside surface and layers sized to receive a wearer's head;

the layers having differing dynamic impedances, a layer adjacent to the shell having a low dynamic impedance, and subsequent layers being arranged in a pattern of alternating high and low dynamic impedances to each other.

24. A device for protecting a user or an object from impact, comprising a shell and alternating layers of energy absorbing foamed polymeric material having different dynamic impedances disposed inside the shell, one of the layers being in direct contact with shell; the layer in direct contact with said shell having a low dynamic impedance, and subsequent layers being arranged in a pattern of alternating high and low dynamic impedances to each other; said layers being an open-cell foam.

25. A helmet, comprising:

a) a stiff shell;

b) a first layer of impact-energy-absorbing material adjacent said shell;

c) a second layer of impact-energy-absorbing material adjacent said first layer; and d) a third layer of impact-energy-absorbing material adjacent said second layer;

said second layer having a dynamic impedance higher than the dynamic impedance of said first and third layers;

said shell having a stiffness greater than said first and third layers;

said first, second and third layers are an open-cell foam.

26. A helmet, comprising:

a) a stiff shell;

b) a first layer of impact-energy-absorbing material adjacent said shell;

c) a second layer of impact-energy-absorbing material adjacent said first layer; and d) a third layer of impact-energy-absorbing material adjacent said second layer;

said second layer having a dynamic impedance higher than the dynamic impedance of said first and third layers;

said shell having a stiffness greater than said first and third layers, each said layer comprising a foamed polymeric material.

* * * * *